US007026611B2

(12) United States Patent
Atkinson et al.

(10) Patent No.: US 7,026,611 B2
(45) Date of Patent: Apr. 11, 2006

(54) ANALYTICAL INSTRUMENTS, IONIZATION SOURCES, AND IONIZATION METHODS

(75) Inventors: David A. Atkinson, Idaho Falls, ID (US); Paul Mottishaw, Chubbuck, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 103 days.

(21) Appl. No.: 09/847,165

(22) Filed: May 1, 2001

(65) Prior Publication Data

US 2002/0162967 A1 Nov. 7, 2002

(51) Int. Cl.
*H01J 27/00* (2006.01)

(52) U.S. Cl. ..... 250/288; 250/423 R; 250/425

(58) Field of Classification Search ..... 250/286, 250/288, 432 R, 497.21, 504 R, 423 R, 425
See application file for complete search history.

(56) References Cited

U.S. PATENT DOCUMENTS 4,028,617 A * 6/1977 Kamo et al. ..... 324/464
4,458,153 A * 7/1984 Wesley ..... 250/435
4,647,772 A * 3/1987 Lewis et al. ..... 250/288
5,081,397 A * 1/1992 Liang et al. ..... 315/111.21
5,345,079 A * 9/1994 French et al. ..... 250/288
5,465,607 A * 11/1995 Corrigan et al. ..... 73/23.36
5,554,854 A * 9/1996 Blake ..... 250/492.21
5,633,506 A * 5/1997 Blake ..... 250/492.21
5,955,886 A * 9/1999 Cohen et al. ..... 324/464
6,051,841 A * 4/2000 Partlo ..... 250/504 R
6,326,616 B1 * 12/2001 Andrien et al. ..... 250/288
6,407,382 B1 * 6/2002 Spangler ..... 250/286

* cited by examiner

*Primary Examiner*—Kiet T. Nguyen
(74) *Attorney, Agent, or Firm*—Wells St. John P.S.

(57) ABSTRACT

Methods and apparatus for simultaneous vaporization and ionization of a sample in a spectrometer prior to introducing the sample into the drift tube of the analyzer are disclosed. The apparatus includes a vaporization/ionization source having an electrically conductive conduit configured to receive sample particulate which is conveyed to a discharge end of the conduit. Positioned proximate to the discharge end of the conduit is an electrically conductive reference device. The conduit and the reference device act as electrodes and have an electrical potential maintained between them sufficient to cause a corona effect, which will cause at least partial simultaneous ionization and vaporization of the sample particulate. The electrical potential can be maintained to establish a continuous corona, or can be held slightly below the breakdown potential such that arrival of particulate at the point of proximity of the electrodes disrupts the potential, causing arcing and the corona effect. The electrical potential can also be varied to cause periodic arcing between the electrodes such that particulate passing through the arc is simultaneously vaporized and ionized. The invention further includes a spectrometer containing the source. The invention is particularly useful for ion mobility spectrometers and atmospheric pressure ionization mass spectrometers.

17 Claims, 6 Drawing Sheets

ANALYTICAL INSTRUMENTS, IONIZATION SOURCES, AND IONIZATION METHODS

CONTRACTUAL ORIGIN OF THE INVENTION

This invention was made with United States Government support under Contract No. DE-AC07-94ID13223, now Contract No. DE-AC07-99ID13727 awarded by the United States Department of Energy. The United States Government has certain rights in the invention.

FIELD OF THE INVENTION

This invention pertains to methods and apparatus for spectrometric analysis of a sample, and more particularly to a method and apparatus for the simultaneous vaporization and ionization of a sample to be analyzed using a spectrometer. In one aspect, the invention comprises an ion mobility spectrometer or an atmospheric pressure mass spectrometer.

BACKGROUND OF THE INVENTION

The modem practice of ion mobility spectrometry (IMS) normally involves ionization processes centered on the use of a radioactive $^{63}$Ni or $^{3}$H source, typically foil. Aside from the fact that the radioactive source has logistical problems in documenting control and safety of the source, including licensing issues and transport of apparatus using the radioactive source into foreign countries, this type of ionization device relies upon gas phase processes to effect ionization. Therefore, particulate matter is analyzed after a transfer of analyte ions from the particulate to the gas phase, typically by thermal desorption/vaporization, as is the current popular practice.

Another drawback to the current technology in ion mobility spectrometry (IMS) and atmospheric pressure ionization (API) mass spectrometry is that typically the sample particulate needs to be vaporized before introduction into an ionization source, leading to potential thermal degradation of analyte ions and increased instrument complexity in the way of controls and space requirements for both ionization and vaporization elements. In addition, IMS instruments require that an ion gate be placed in front of the drift tube in the spectrometry analyzer to control the flow of ions into the drift tube. Ion gates are fragile and, thus, affect the ruggedness of an instrument containing such a device. Additionally, ion gates require the addition of complex electronics to drive gate pulses, increasing the cost of IMS instruments.

Since the resurgence of IMS as a technique for field use for applications such as the detection of explosives and other contraband in airports, there has been an increased need to have an inexpensive, robust IMS apparatus available for such use. It is also desirable to have a atmospheric pressure ionization mass spectrometer which does not rely on thermal desorption/vaporization prior to the introduction of analyte ions to the detector.

The use of a electrospray device in mass spectrometry is known as a means for ionizing and vaporizing a sample prior to introduction into the spectrometry analysis section, but such use is limited to mass spectrometers which operate under a vacuum. Further, the liquid transfer medium for carrying the sample into the electrospray device presents a substantially different system than the gas carrier fluid systems used in IMS and API spectrometry.

Therefore, what is needed is a rugged, efficient, non-radioactive method and apparatus for vaporizing and ionizing sample particulate in IMS and API spectrometers.

SUMMARY OF THE INVENTION

A first aspect of the invention includes a simultaneous vaporization and ionization spectrometry source. The source has an electrically conductive conduit configured to receive sample particulate carried by a carrier fluid stream, the conduit having a discharge end with an opening configured to discharge the sample into a spectrometry analyzer. The source further includes an electrically conductive reference device positioned proximate the discharge end of the conduit at a distance greater therefrom than the Paschen distance.

A second aspect of the invention includes a spectrometer having a spectrometry analyzer and a simultaneous vaporization and ionization spectrometry source in accordance with the first aspect of the invention.

The invention further includes methods for simultaneous vaporization and ionization of sample particulate to produce analyte ions for spectrometric analysis. In a third aspect of the invention, the method includes the steps of providing a particulate sample to be spectrometrically analyzed, providing a first electrode, and providing a second electrode proximate the first electrode. An electrical potential is maintained between the first electrode and the second electrode such that an electrical potential exists between the two electrodes. A carrier fluid is provided to transport the particulate sample to a point proximate the first and second electrodes. Electrical arcing between the first and second electrodes is caused at a time when the particulate sample arrives at the point proximate the first and second electrodes to cause at least partial vaporization and ionization of the particulate sample and thereby produce analyte ions, which can thereafter be analyzed in a spectrometry analyzer.

In a fourth aspect of the invention, a method for simultaneous vaporization and ionization of a particulate sample in accordance with the third aspect of the invention is disclosed. However, in the fourth aspect the electrical potential at the first electrode and the electrical potential at the second electrode are maintained at a point above an is electrical breakdown potential between the two electrodes, such that the arrival of the particulate sample at the point proximate to the two electrodes causes a corona discharge as a result of altering the breakdown potential. The corona discharge causes at least partial vaporization and ionization of the particulate sample to produce analyte ions.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
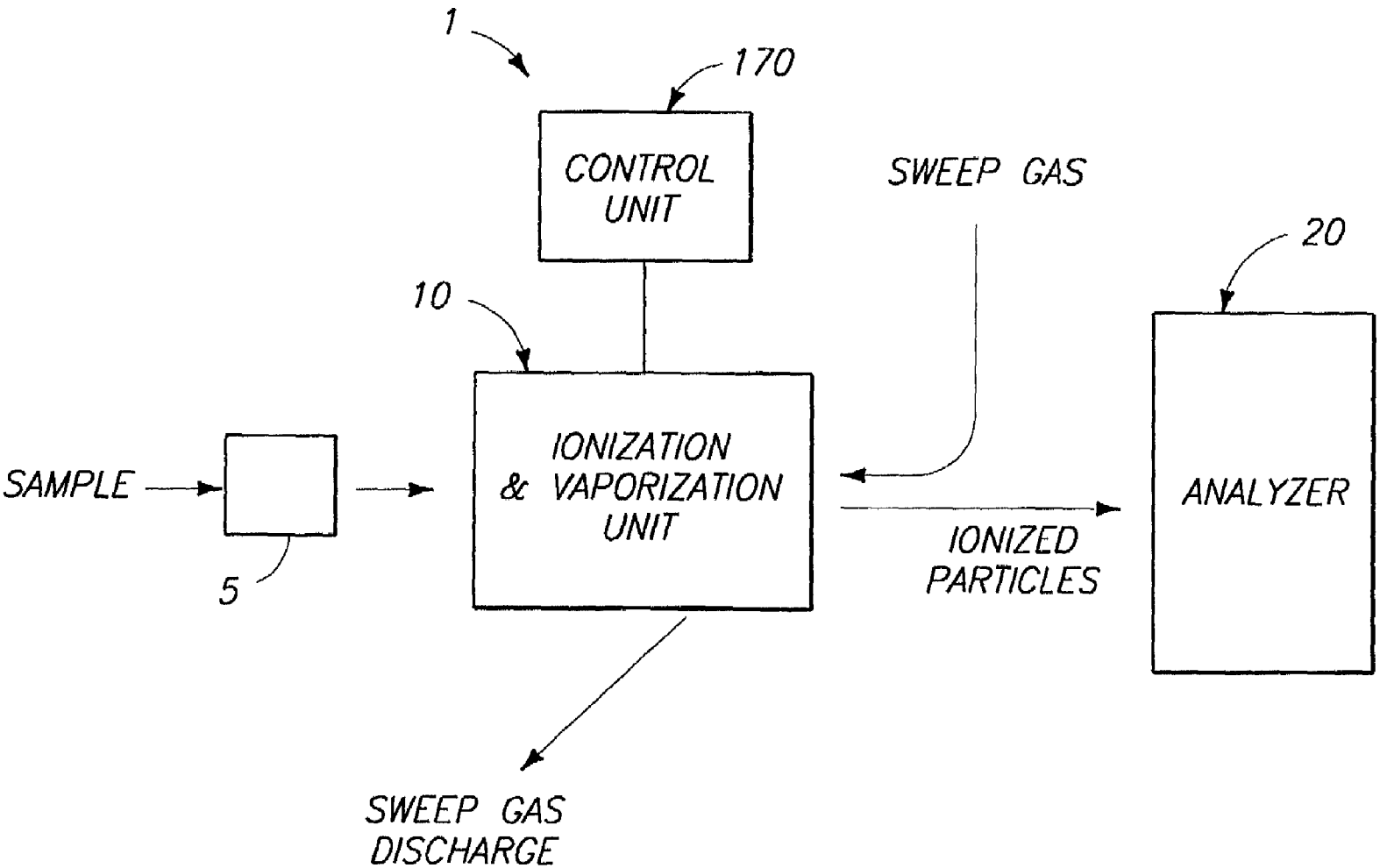
FIG. 1 is a schematic diagram showing a spectrometer which can use the simultaneous vaporization and ionization source of the present invention and in which the methods of the present invention can be carried out.

Turning to FIG. 1, a simplified block diagram of a spectrometer which can use the simultaneous vaporization and ionization spectrometry source of the present invention is shown. The methods of the present invention can also be practiced using such a spectrometer. The spectrometer includes a sample entry section 5 configured to suspend a sample in a carrier fluid. In applications such as IMS and API mass spectrometry, the carrier fluid is typically a gas. The spectrometer 1 further comprises an ionization and vaporization unit 10. Traditionally, such units include both a thermal desorption/vaporization component to vaporize the sample, as well as a separate unit for ionization of the vaporized sample. Following ionization, the ionized particles are drawn toward the spectrometry analyzer 20. Such is typically performed by applying an electric field to the analyzer to attract the ionized, charged particles. A sweep gas counter flows against the directional flow of the ionized particles to remove any neutral particles from the stream to prevent them from entering the drift tube of the analyzer 20.

Figure 2:
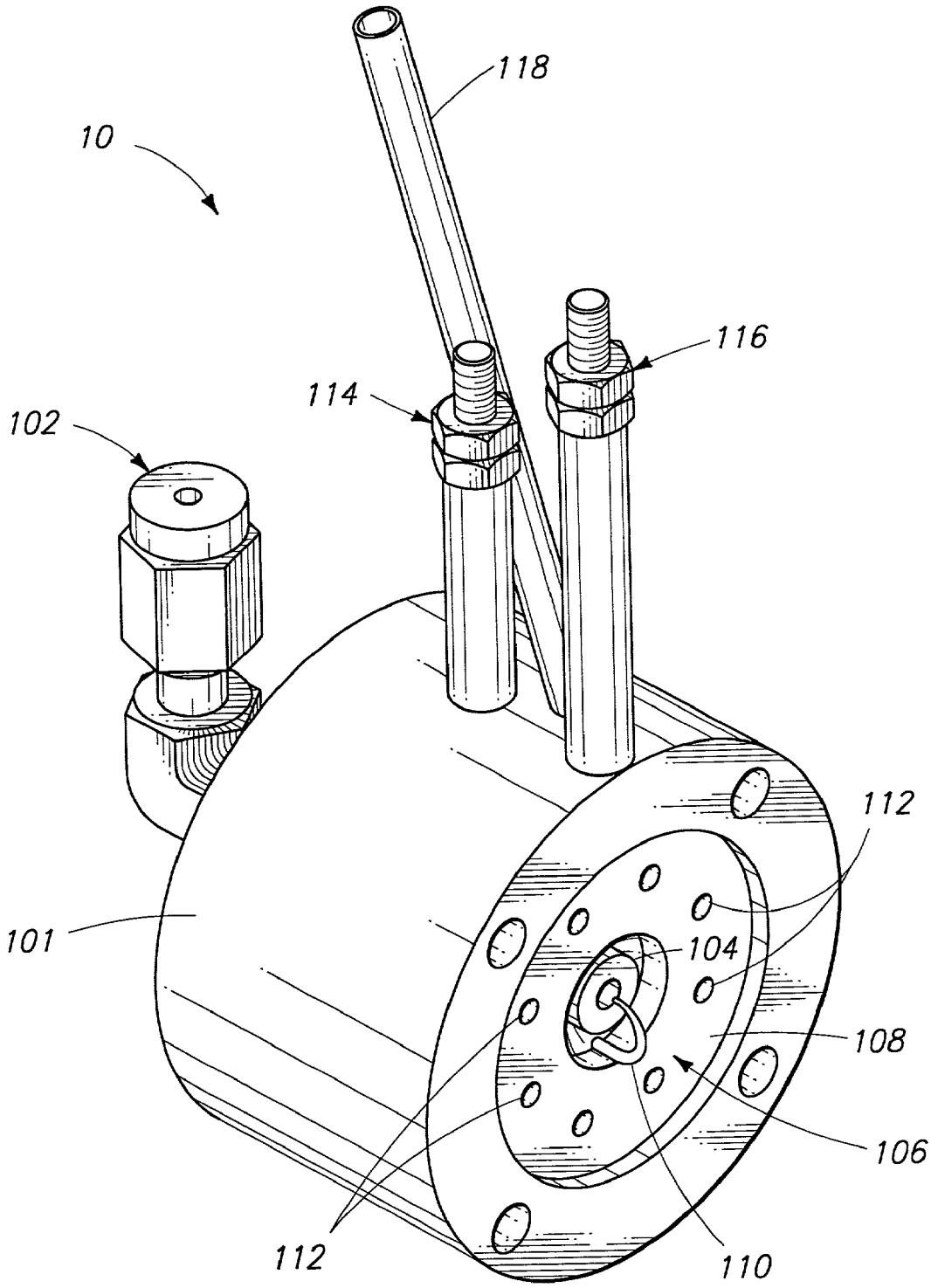
FIG. 2 is an isometric drawing of one embodiment of a simultaneous vaporization and ionization spectrometry source in accordance with the present invention.

Turning to FIG. 2, a first embodiment of the apparatus in accordance with the present invention is shown. The simultaneous vaporization and ionization spectrometry source 10 of FIG. 2 includes an electrically conductive conduit 104 and an electrically conductive reference device 106. A sample to be analyzed in the spectrometry analyzer is provided to the conduit 104 via the sample inlet 102. The sample is typically provided to the conduit by way of a carrier fluid which, in IMS and API spectrometry, typically comprises a gas. The sample is typically in the form of particulate in the gas stream.

The electrically conductive conduit 104 may alternately be known as the sample outlet or the first electrode. A first electrical potential is applied to the conduit 104 by way of an electrical contact or connector 114. A second electrical potential is applied to the electrically conductive reference device 106 by way of the electrical contact or connector 116. The conduit 104 and the reference device 106 are electrically isolated such that current does not flow between these two components. The electrically conductive reference device 106 preferably further includes a discharge portion 110 which is located proximate, but not in contact with, the conduit 104. More preferably, the discharge portion 110 is located a distance from the conduit greater than the Paschen distance, being the distance at which an electrical potential between two items cannot be maintained. The Paschen distance will vary according to atmospheric pressure, atmospheric temperature, humidity, the electrical potential between the two electrodes, the type of carrier gas used, and other factors. Since many of these factors are typically known or can be measured, it is typically possible to calculate the Paschen distance with some accuracy. A margin of safety can also be provided to account for variances in these variables.

Figure 3:
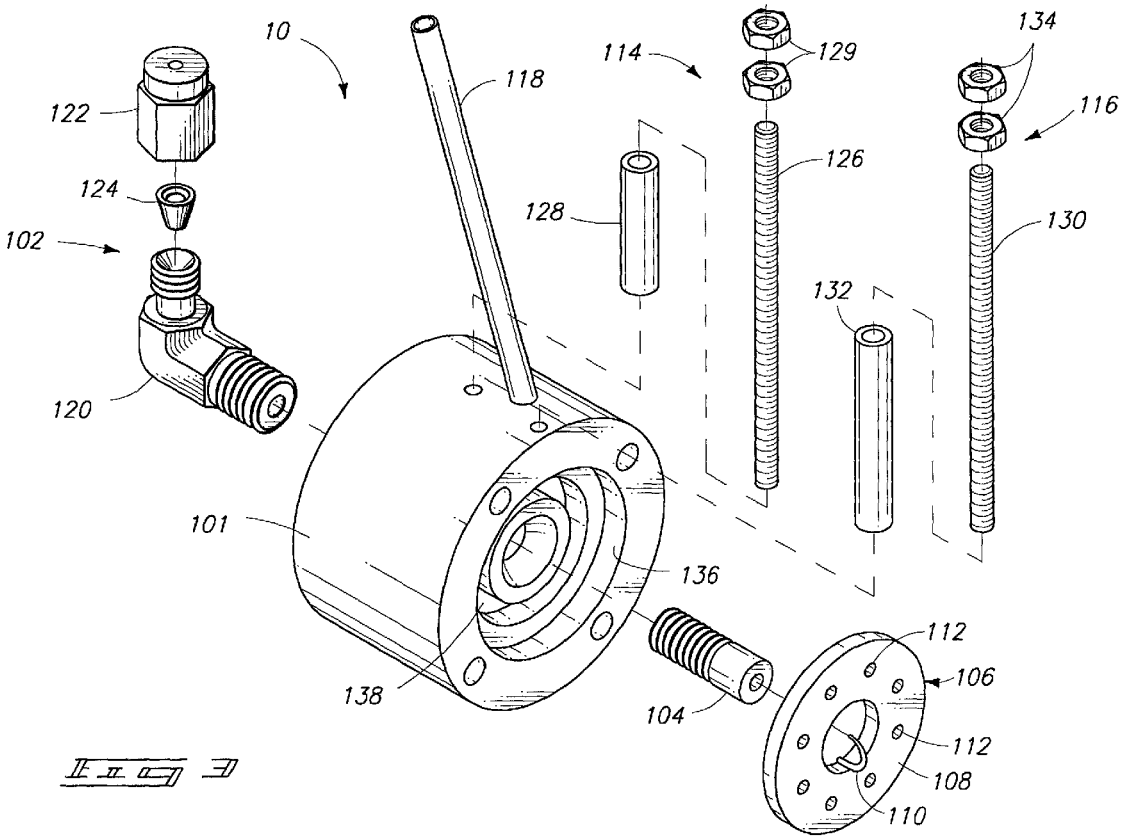
FIG. 3 is an exploded diagram of the spectrometry source of FIG. 1 shown in isometric view.

Turning to FIG. 3, an exploded isometric diagram of the apparatus 10 of FIG. 2 is shown. In the particular embodiment shown, it is seen that the sample inlet 102 and the conduit 104 comprise separate components. The sample inlet 102 is further comprised of instrument tubing components 120, 122 and 124. The sample inlet 102 and the conduit 104 are fitted to body 101 which is preferably manufactured from an electrically insulating material. The reference device 106 is provided with a plurality of openings or holes 112 which allow sweep gas to pass from the ionization area into the channel 138 where the gas is then removed at the sweep gas outlet line 118 by way of sweep gas outlet path 142 (see FIG. 4).

Figure 4:
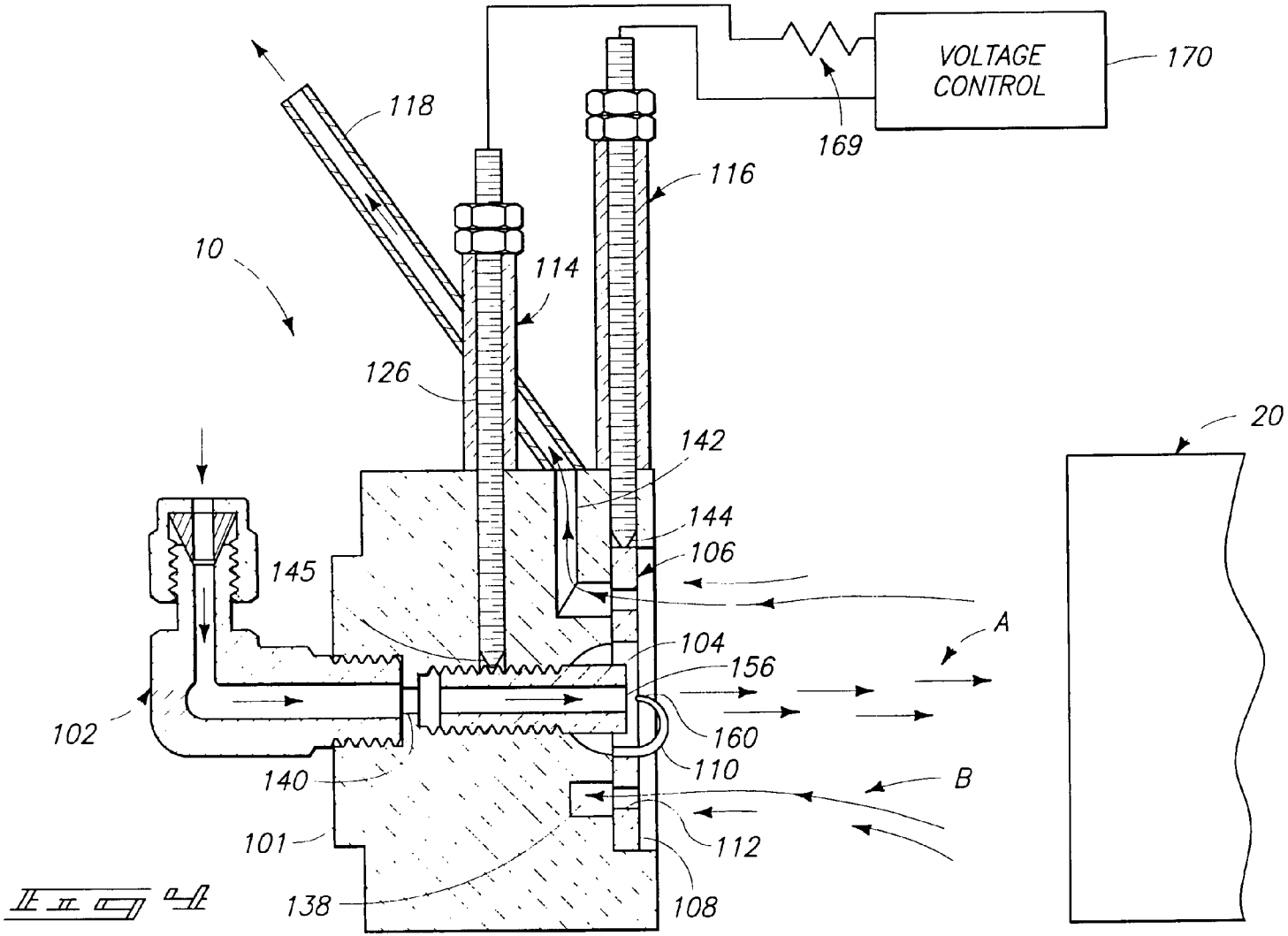
FIG. 4 is a side elevation sectional view of the spectrometry source of FIG. 2.

Turning to FIG. 4, a side sectional elevation view of the first embodiment of the apparatus 10 shown in FIG. 2 is shown. In the embodiment shown, conduit 104 is threaded into the body 101, and sample inlet section 102 is threaded into the other end of the body 101. The sample inlet 102 and conduit 104 are separated by a region 140, thus electrically isolating the conduit 104 from the sample inlet 102. This is done since an electrical potential is provided to conduit 104 by contact 114 and it is, therefore, preferable to electrically isolate the sample inlet 102 to prevent accidental disruption of the electrical potential established between the conduit 104 and the reference device 106.

FIG. 4 also shows the manner in which the first electrical contact 114 and the second electrical contact 116 are inserted into the body 101 in order to contact the conduit 104 and the reference device 106 at first electrical coupling 145 and second electrical coupling 144, respectively.

Returning to FIG. 3, it is seen that the first electrical contact 114 comprises an electrical connector 126 which is sheathed by an electrical insulator 128. Securing devices 129 (here, nuts) are used to secure an electrical source to the first contact. In a like manner, the second contact 116 comprises an electrical connector 130, an insulating sheath 132, and securing devices 134 (here, nuts) to attach an electrical source to the contact. Note that an electrical ground wire can also be connected to contact 114 or 116 as opposed to an electrical source.

Referring again to FIG. 4, the holes 112 in the reference device 106 allowing sweep gas to pass into the annular space 138 and out through the sweep gas exit port 142 and outlet line 118 are clearly shown. Sweep gas moves in the direction indicated by arrows B, whereas the ionized particles move in the direction indicated by arrows A towards the spectrometry analyzer 20. Because of the polarity typically applied to the spectrometry analyzer 20 in order to attract ionized analyte into the drift tube, in the preferred embodiment a positive voltage is applied to the electrical contact 116 and, hence, the reference device 106. Consequently, a ground potential is applied to the electrical contact 114, and hence, the conduit 104. In one embodiment, the electrical potential between the conduit and the reference device is at least ten volts. More preferably, the electrical potential between the conduit and the reference device is less than about 250 volts.

The apparatus can further be provided with a ballast resistor 169 and a voltage controller 170 as shown in FIG. 4. The ballast resistor can provide a current limitation in an arc generated during operation of apparatus 10. Such can assist in controlling the arc, and in protecting the voltage controller from a "dead short" scenario during arcing. Although ballast resistor 169 is shown to be external and separate from voltage controller 170, it is to be understood that ballast resistor 169 could also be provided as a component of voltage controller 170.

The voltage controller can be a programable device and can be configured to allow the electrical potential between the conduit and the reference device to be selectively determined. The voltage controller can be further provided with instrumentation (not shown) to measure conditions which can affect the Paschen distance. Based on these measurements and calculations made by a processor within the voltage controller, the electrical potential between the conduit and the reference device can be varied using the voltage controller. The voltage controller can also be a manually adjustable unit allowing an operator to selectively establish the potential between the conduit 104 and reference device 106.

The reference device 106 shown in FIG. 4 comprises a flat metallic ring 108 having a probe or tip 110 connected thereto and positioned near the discharge end 156 of the conduit 104. As discussed previously, the tip 160 of the probe 110 is maintained at a distance greater than the Paschen distance from the conduit 104.

Figure 5:
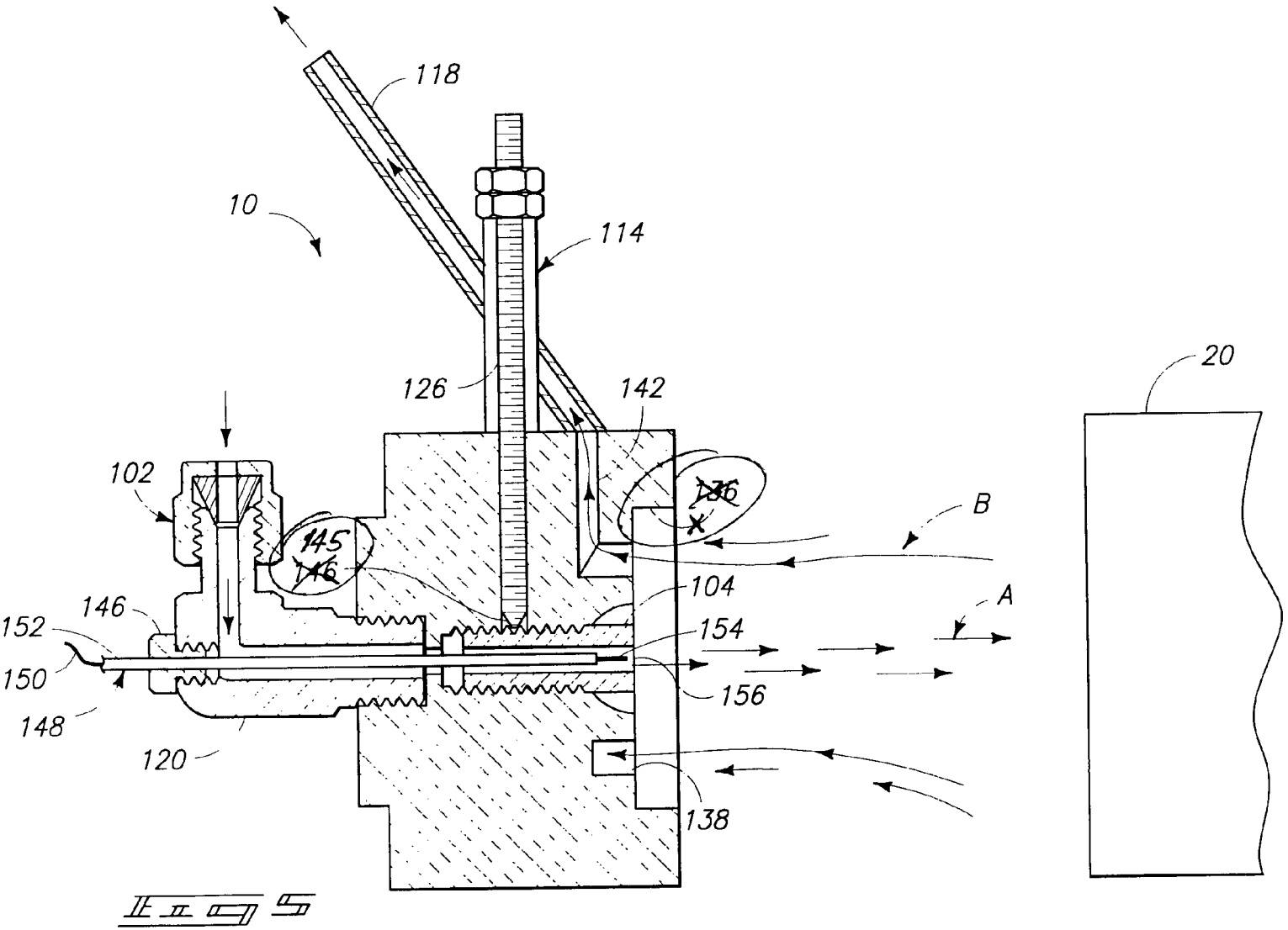
FIG. 5 is a side elevation sectional view of an alternate embodiment of the spectrometry source of FIG. 3.

Turning to FIG. 5, an alternate embodiment of the invention is shown wherein the reference device 106 of FIG. 4 has been replaced with reference device 148. Reference device 148 comprises an electrical wire 150 having insulation 152 disposed thereabout. In the embodiment shown, the reference device 148 is inserted through a small opening in the sample inlet 102, which is then plugged with a plug 146. The reference device 148 passes along the conduit 104 until the end of the reference device is positioned near the discharge end 156 of the conduit. The end of the reference device has the insulation removed to expose a small piece of conductive metal 154 at the end of the conduit 104. Again, the electrical contact 154 is positioned such that it is greater than the Paschen distance from any surface of conduit 104. The embodiment shown in FIG. 5 is a preferable configuration to that shown in FIG. 4 since the design shown in FIG. 5 projects the ionized particles indicated by arrow A more efficiently towards the spectrometry analyzer 20.

Preferably, the point of the reference device 106 or 148 nearest the conduit 104, being the point at which electrical arcing will occur, is fabricated from a material selected from the group consisting of stainless steel, gold, and platinum. Platinum is a preferred material of construction for the end of the reference device where electrical arcing will occur, as platinum tends to resist pitting due to electrical arcing.

Figure 6:
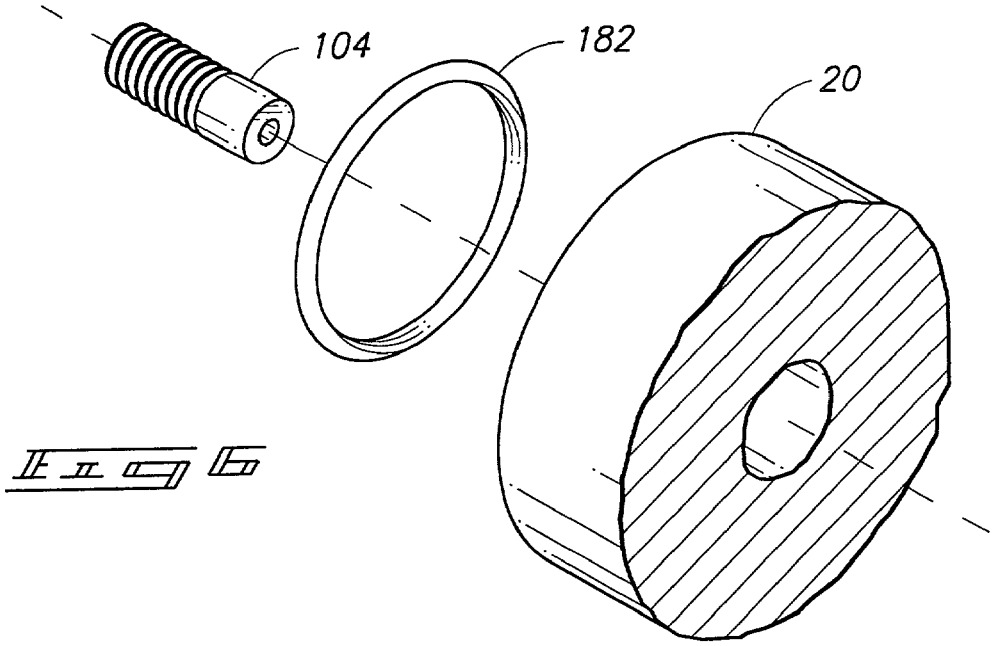
FIG. 6 is an isometric diagram showing an alternate embodiment of the reference device used in the present invention.
Figure 7:
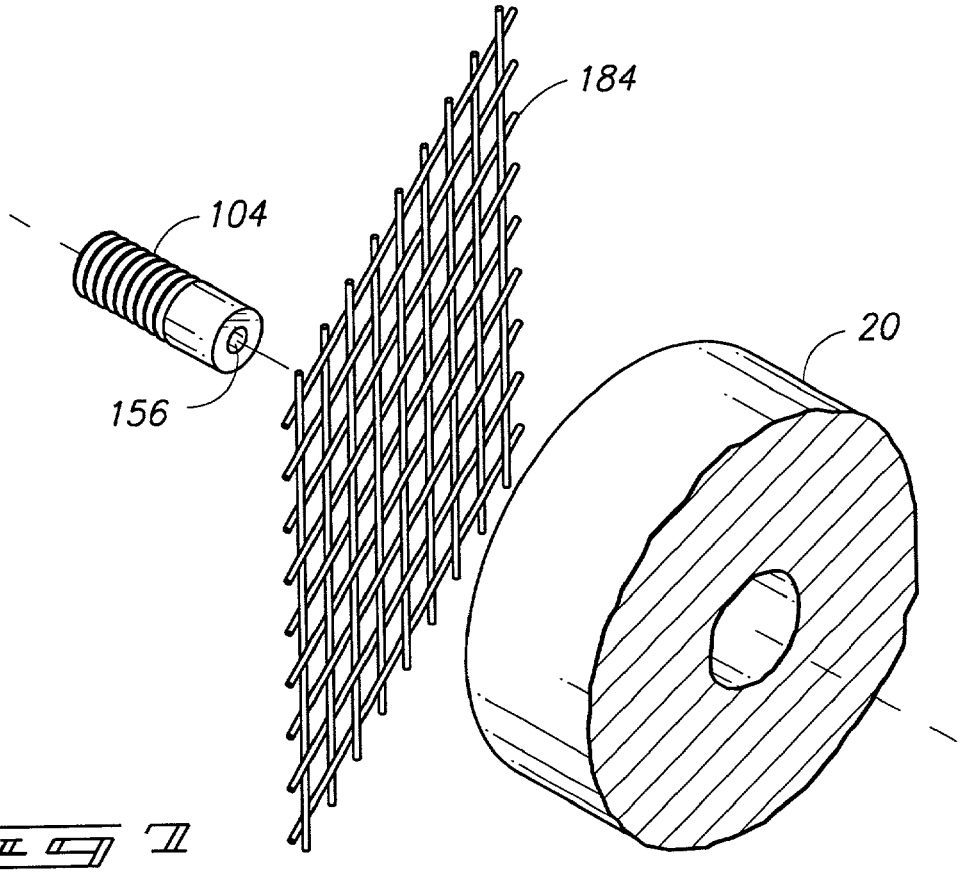
FIG. 7 is an isometric diagram showing an alternate configuration for the reference device used in the present invention.

In one embodiment, the conduit 104 comprises a hypodermic needle. Turning to FIG. 6, an alternate embodiment of the invention is shown wherein the reference device 182 comprises a circular ring which is positioned between the conduit 106 and the spectrometry analyzer 20. In FIG. 7, yet another embodiment is shown wherein the reference device 184 comprises a metal grate which is positioned between the discharge end 156 of conduit 106 and the spectrometry analyzer 20.

Spectrometer:

In addition to disclosing a simultaneous vaporization and ionization spectrometry source, the invention includes a spectrometer including a ionization and vaporization source in accordance with the above disclosure. The spectrometer generally comprises those elements shown in FIG. 1, being a sample inlet section 5, an ionization vaporization unit 10 in accordance with the above disclosure, and a spectrometry analyzer 20. Preferably, the sample inlet portion 5 and the spectrometry analyzer 20 comprise ionization mobility spectrometry components or atmospheric pressure ionization mass spectrometry components. That is, the sample particulate is suspended in a carrier fluid comprising a gas. Further, in each application, the spectrometry analyzer is operated at ambient pressures rather than at a vacuum, as it typical in mass spectrometry. It is noted that mass spectrometers are run at vacuum and IMS are run at ambient pressures. A device of the present invention can operate at ambient for mass spectrometry by placing the device outside of a vacuum, near a mass spectrometer, with a small orifice leading into the mass spectrometer (at vacuum). Ions from the device can go through the orifice.

The spectrometer can further comprise the control unit 170 shown in FIGS. 1 and 4 and described further herein, and can additionally comprise a ballast resistor 169 provided separately from the control unit or as a component of the control unit. The voltage controller 170 can be a programmable voltage controller. Accordingly, the voltage controller 170 can be programed to establish the electrical potential between the conduit 104 and the reference device 106 at a voltage slightly less than the breakdown potential between the two electrodes. The breakdown potential is the electrical potential at which electrical arcing will occur between the two electrodes. This can be accomplished by increasing the potential between the two electrodes until electrical arcing occurs and thereafter, slightly reducing the electrical potential to establish the voltage at a potential slightly less than the breakdown potential. When a sample particulate arrives at the discharge end of the conduit 104, the particle will interfere with the voltage equilibrium between the conduit 104 and the reference device 106 or 148, causing electrical arcing to occur between the conduit 104 and the reference device. This arcing will cause a corona effect which will simultaneously vaporize and ionize at least a portion of the sample particulate, producing analyte ions which can then be analyzed in the spectrometry analyzer 20.

The control unit 170 of FIG. 1 can also be configured to generate voltage pulses between the conduit 104 and the reference device 106 or 148 to periodically create a corona effect, rather than relying on the arrival of particulate matter at the discharge end 156 of the conduit. Such can be used when a large quantity of sample particulate is anticipated which can cause a high incidence of arcing in the configuration described above wherein the potential between the conduit and the reference device is established slightly below the breakdown potential.

In a third embodiment, the control unit 170 of FIG. 1 can be configured to establish the electrical potential between the conduit 104 and the reference device 106 or 148 such that there is continuous arcing or corona effect between the two electrodes.

In the embodiment described wherein the electrical potential is established to occur on a periodic pulse, the spectrometer can be constructed without the need for an ion gate between the ionization unit and the spectrometry analyzer 20.

Method:

The invention further includes methods for simultaneous vaporization and ionization of sample particulate to produce analyte ions for spectrometric analysis. The method includes the steps of providing a particulate sample to be spectrometrically analyzed. Such can be accomplished in any of the traditional methods known for providing a sample to an IMS or API mass spectrometer. The method further includes the steps of providing a first electrode and providing a second electrode proximate the first electrode. Referring to FIG. 4, the first and second electrodes are provided in the form of the conduit 104 and the reference device 106, with no particular association as to which of these two constitutes either the first or second electrode. At least a portion of the two electrodes are provided in close proximity such that electrical arcing can occur between the two electrodes when a sufficiently high electrical potential is applied there between.

In the next step in the method, a first electrical potential is provided at the first electrode and a second electrical potential is provided at the second electrode, such that an electrical potential exists between the two electrodes. Either of the two electrical potentials can consist of ground potential or a zero voltage potential. The other electrical potential typically comprises a positive voltage such that a differential voltage is established between the two electrodes. A carrier fluid is provided for transporting the particular sample to a point proximate the first and second electrodes. In IMS and API spectrometry, the carrier fluid typically comprises gas such as air or nitrogen. The particulate sample provided is thus transported via the carrier fluid to a point proximate to the first and second electrodes. The method further includes the step of causing electrical arcing between the first and second electrodes at a time when the particulate sample arrives at a point proximate thereto, to cause at least partial simultaneous vaporization and ionization of the particulate sample and thereby produce analyte ions which can be analyzed the spectrometry analyzer. Preferably, the method is practiced using an IMS or an API mass spectrometer.

In a first variation of the method, the electrical potential between the first and second electrodes is maintained slightly above the breakdown potential between the two electrodes. Electrical arcing between the first and second electrodes is caused by the arrival of the particulate sample at a point where the two electrodes are proximate to one another. Arrival of the sample particulate at this point alters the breakdown potential between the electrodes, resulting in a corona discharge which causes at least partial simultaneous vaporization and ionization of the particulate sample and thereby produce analyte ions.

Establishing the electrical potential between the first and second electrodes at a point slightly below the breakdown potential can be accomplished by increasing the potential between the two electrodes until a corona discharge occurs in the absence of particulate sample at a point proximate to the first and second electrodes. The potential between the two electrodes is then reduced slightly to create an equilibrium state between the electrodes where no corona discharge occurs in the absence of sample particulate at a point proximate to the two electrodes. Thereafter, the arrival of particulate sample at a point proximate to the two electrodes will alter the breakdown potential, causing a corona discharge and at least partial vaporization and ionization of the particulate sample. In this variation, the potential between the two electrodes is established at between about 10 and about 50 volts in the equilibrium state. It is noted, however, that the potential between the two electrodes is condition dependent, and can vary depending on distance between the electrodes, temperature, humidity and gas type, for example. Such variation can change the potential to outside of the stated range between about 10 and about 50 volts.

In a second variation on the method, the electrical potential between the first and second electrodes is maintained such as to produce a continuous arcing there between, thereby causing continuous simultaneous vaporization and ionization of at least a portion of the sample particulate passing through the corona.

In a third variation of the method, the electrical potential between the first and second electrodes is initially maintained at a level below the breakdown potential between the electrodes. The potential between the two electrodes is then periodically increased to the point where a corona discharge between the electrodes occurs resulting in at least partial simultaneous vaporization and ionization of any particulate sample which happens to pass through the corona. In this manner, the flow of analyte ions to the spectrometry analyzer can be controlled according to any preferred timing sequence by the use of the control unit 170 of FIG. 1. Operating the spectrometer according to the method and the third variation removes the need for an ion gate to be placed in front of the spectrometry analyzer.

While the invention has been described particularly with respect to sample which is in particulate form, it should be understood that the particle need not be a solid particle, but can, in fact, comprise a droplet of entrained liquid in a gas steam of carrier fluid.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An ionization source comprising:

a sample inlet tube in fluid communication with an electrically conductive conduit, the sample inlet tube being electrically isolated from the electrically conductive conduit, wherein the conduit comprises a first end and a second end, the first end being configured to receive a substantially unionized sample from the sample inlet tube and the second end being configured to discharge the sample from the conduit;

an electrically conductive reference device positioned proximate the second end of the conduit, the reference device and the conduit having an ionization area therebetween, wherein the reference device and the conduit are configured to ionize at least a portion of the sample within the ionization area; and an ion analyzer configured to receive at least some of the portion of the sample ionized within the ionization area.

2. The source of claim 1 wherein the sample inlet tube is configured to convey the sample in a carrier fluid from the tube to conduit.

3. The source of claim 1 wherein both the electrically conductive conduit and the reference device are coupled to a body, the body comprising openings configured to receive first and second contacts, the first contact being in electrical communication with the electrically conductive conduit and the second contact being in electrical communication with electrically conductive reference device.

4. The source of claim 3 wherein the body couples the sample inlet tube to the conduit.

5. The source of claim 1 wherein the reference device further comprises a discharge portion coupled to the reference device, the discharge portion being located between the second end of the conduit and the ion analyzer.

6. The source of claim 5 wherein the discharge portion extends from the reference device to a point proximate the second end of the conduit.

7. The source of claim 1 wherein the reference device further comprises a plurality of openings, the openings being configured to allow for the removal of sweep gas from the ionization area.

8. The source of claim 7 wherein both the conduit and the reference device are coupled to a body, the body comprising at least one sweep gas removal opening in fluid communication with the plurality of openings of the reference device.

9. The source of claim 1 wherein the reference device is located within the conduit.

10. The source of claim 1 wherein a distance between the conduit and the reference device is greater than the Paschen distance.

11. The source of claim 1 wherein the reference device comprises a metal comprising one or more of stainless steel, platinum, and gold.

12. The source of claim 1 wherein the sample inlet tube comprises metal.

13. The source of claim 1 wherein the conduit is electrically grounded.

14. The source of claim 1 wherein the reference device and the conduit are configured to have different electric potentials applied thereto.

15. The source of claim 1 wherein the interior diameters of the sample inlet tube and conduit are approximately the same.

16. The source of claim 1 wherein a length of the conduit extending from the first end to the second end exceeds a heighth of the conduit.

17. The source of claim 1 wherein the sample inlet tube is coupled to the conduit via the an insulative body.

* * * * *